US010105609B2

(12) United States Patent
Boyle et al.

(10) Patent No.: US 10,105,609 B2
(45) Date of Patent: Oct. 23, 2018

(54) SYSTEM AND METHOD FOR POSITIONING VEHICLES OF AN AMUSEMENT PARK ATTRACTION

(71) Applicant: Universal City Studios LLC, Universal City, CA (US)

(72) Inventors: Patrick Devin Boyle, Orlando, FL (US); Keith Michael McVeen, Orlando, FL (US); Eric A. Vance, Orlando, FL (US); Thierry Coup, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 218 days.

(21) Appl. No.: 15/085,910

(22) Filed: Mar. 30, 2016

(65) Prior Publication Data

US 2016/0287999 A1 Oct. 6, 2016

Related U.S. Application Data

(60) Provisional application No. 62/141,086, filed on Mar. 31, 2015.

(51) Int. Cl.
*A63G 7/00* (2006.01)
*A63G 21/06* (2006.01)

(52) U.S. Cl.
CPC ..... *A63G 21/06* (2013.01); *A63G 7/00* (2013.01)

(58) Field of Classification Search
CPC ..... A63G 21/00; A63G 21/04; A63G 21/06; A63G 21/08; A63G 21/20; A63G 21/22; A63G 31/00; A63G 31/02
See application file for complete search history.

(56) References Cited

U.S. PATENT DOCUMENTS

| | | | | |
|---|---|---|---|---|
| 1,549,927 | A | 8/1925 | Sherry | |
| 6,269,750 | B1 | 8/2001 | Cornwell et al. | |
| 8,393,275 | B2 | 3/2013 | Jacobi et al. | |
| 9,272,224 | B2 | 3/2016 | Nemeth et al. | |
| 2009/0272289 | A1* | 11/2009 | Baker | A63G 7/00 104/76 |
| 2012/0149480 | A1 | 6/2012 | Crawford et al. | |
| 2013/0059670 | A1 | 3/2013 | Crawford et al. | |

FOREIGN PATENT DOCUMENTS

| | | |
|---|---|---|
| EP | 2301637 | 3/2011 |
| WO | 2015/04195 | 3/2015 |

OTHER PUBLICATIONS

PCT/US2016/025289 Search Report and Written Opinion dated Jun. 8, 2016.

* cited by examiner

*Primary Examiner* — Robert J McCarry, Jr.
(74) *Attorney, Agent, or Firm* — Fletcher Yoder, P.C.

(57) ABSTRACT

An apparatus for an amusement park includes a bogie system positioned on a track. The bogie system directs motion along the track. The apparatus also includes an arm extending radially outward from the bogie system. The arm is rotatably coupled to a body of the bogie system. Furthermore, the apparatus includes a vehicle positioned on the arm.

19 Claims, 8 Drawing Sheets

SYSTEM AND METHOD FOR POSITIONING VEHICLES OF AN AMUSEMENT PARK ATTRACTION

CROSS REFERENCE TO RELATED APPLICATION

This application claims the benefit of U.S. Provisional Application No. 62/141,086, entitled "SYSTEM AND METHOD FOR POSITIONING PODS OF AN AMUSEMENT PARK ATTRACTION," filed Mar. 31, 2015, which is hereby incorporated by reference in its entirety.

FIELD OF DISCLOSURE

The present disclosure relates generally to the field of amusement parks. More specifically, embodiments of the present disclosure relate to systems and methods utilized to provide amusement park experiences.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks often include attractions that incorporate simulated competitive circumstances between the attraction participants. For example, the attractions may have cars or trains in which riders race against one another along a path (e.g., dueling coasters, go carts). Incorporating the competitive circumstances may provide an additional entertainment value to the riders, as well as increase variety for riders utilizing the attraction multiple times. However, traditional systems may include several track sections to provide the simulated competitive circumstances, thereby increasing the cost and complexity of the attraction. It is now recognized that it is desirable to provide improved systems and methods for simulated racing attractions that provide excitement for riders.

BRIEF DESCRIPTION

Certain embodiments commensurate in scope with the originally claimed subject matter are discussed below. These embodiments are not intended to limit the scope of the disclosure. Indeed, the present disclosure may encompass a variety of forms that may be similar to or different from the embodiments set forth below.

In accordance with one embodiment, an apparatus for an amusement park includes a bogie system positioned on a track. The bogie system directs motion along the track. The apparatus also includes an arm extending radially outward from the bogie system. The arm is rotatably coupled to a body of the bogie system. Furthermore, the apparatus includes a vehicle positioned on the arm. The bogie system is configured to move in an operation direction along the track and the vehicle is configured to rotate about the bogie system to change a position of the vehicle with respect to the bogie system.

In accordance with another embodiment, a system includes a bogie system positioned on a track, where the bogie system is configured to move along the track, a plurality of arms extending radially outward from the bogie system, where each of the plurality of arms is rotatably coupled to a body of the bogie system, and a plurality of vehicles, where each vehicle of the plurality of vehicles is positioned on a corresponding arm of the plurality of arms, and where the plurality of vehicles are positioned at different locations from one another with respect to the bogie system.

In accordance with another embodiment, a method for controlling an amusement ride with an automation controller and actuators includes directing a plurality of vehicles in an operation direction along a track using a shared bogie system and a motor actuator, and rotating one or more of the vehicles of the plurality of vehicles about a guide axis with a rotation actuator to adjust a position of the one or more vehicles of the plurality of vehicles with respect to the remaining vehicles of the plurality of vehicles.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
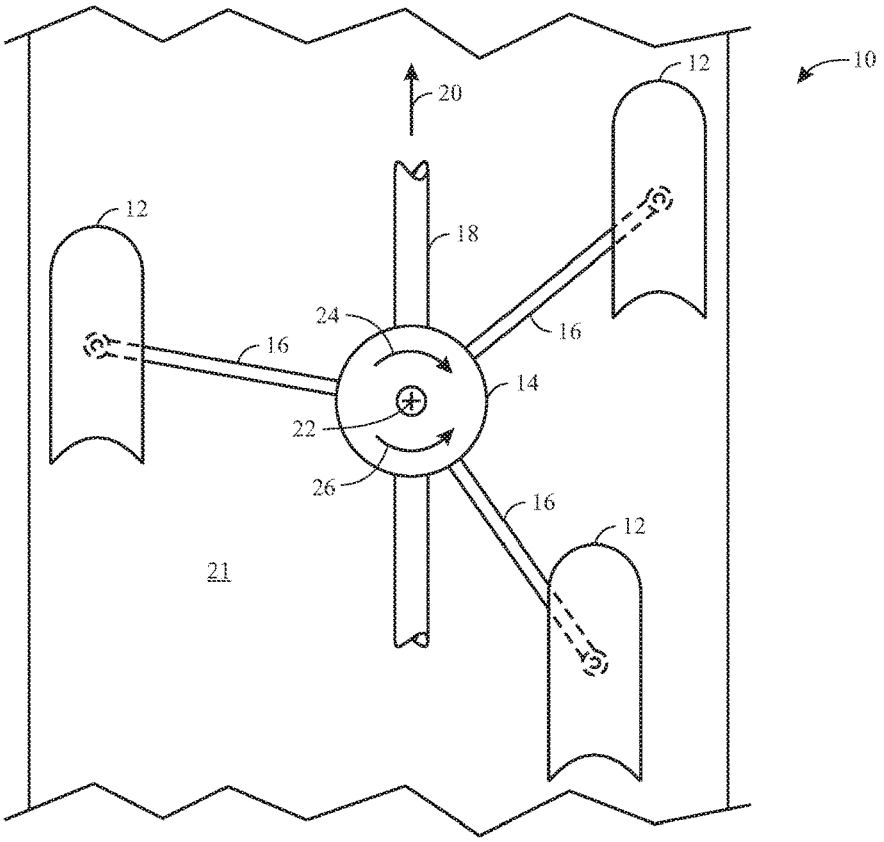
FIG. 1 is a top view of an embodiment of a racer having three vehicles positioned about a guide, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Attractions at amusement parks that involve competitive circumstances (e.g., racing between riders) may be limited by the physical constraints of the footprint of the attraction and by the amount of control over the ride experience. For example, ride vehicles (e.g., go carts) on a multi-lane track may interact with each other but their interactions are typically based on individual riders and the nature of the experience will thus be limited (e.g., the vehicles are typically configured to run relatively slow). Some racing attractions include several track sections (e.g., roller coaster tracks) with attached ride vehicles to provide more centralized control of the ride experience. These tracks may have individual ride vehicles for riders to occupy during the attraction. Unfortunately, the cost of constructing and operating the attraction may be elevated because of the additional track sections. Additionally, the complexity of the control system associated with forming a competitive racing environment may increase because several different track sections may be involved with the attraction. Further, having ride vehicles on separate track sections may make it difficult to simulate certain interactions (e.g., one ride vehicle passing another or sharing a lane with another ride vehicle) because the track sections would be required to merge or cross one another.

Present embodiments of the disclosure are directed to facilitating a simulated competitive racing attraction, in a manner that gives riders the illusion of controlling the outcome of the race. As used herein, simulated competitive racing may refer to a simulation of variable speeds and positions of vehicles configured for housing riders for the duration of the attraction. The vehicles may include separate seating areas or rider housings that are each separately maneuverable about a centralized bogie. For example, riders may be positioned in adjacent vehicles coupled to the same guide (including one or more bogies) and track. In some embodiments, separate bogies or guides may support separate vehicles and the bogies may link or be positioned adjacent one another to achieve similar effects.

The track may simulate a race track (e.g., a road having bends, twists, curves, or the like) wherein the position of the vehicles relative to one another may change throughout the duration of the ride. For example, a first vehicle may "pass" a second vehicle along a curve to simulate the first vehicle taking a lead in the race. Creating such an effect may enhance the likeability of the attraction by providing a variable experience each time the rider visits the attraction (e.g., the vehicle that finishes in first position may change each ride).

In certain embodiments a racer includes vehicles positioned about a guide configured to drive the racer along a track. The vehicles may be coupled to arms extending from the guide that enable rotational movement about a guide axis. For example, an actuator may drive rotational movement of the arms and/or the guide to adjust the circumferential position of the vehicles about the guide axis. Moreover, in certain embodiments, the vehicles may be configured to rotate about a vehicle axis (e.g., an axis substantially parallel to the guide axis at a location where the vehicle is coupled to the arm), thereby enabling the vehicles to spin and/or rotate without adjusting the circumferential position of the vehicles about the guide axis. Furthermore, the vehicles may be configured to move radially, with respect to the guide axis. In certain embodiments, a control system may receive signals from sensors positioned about the racer. For example, the control system may receive a signal indicative of a circumferential position of the vehicle, with respect to the guide axis. Moreover, the controller may output signals to the actuator to adjust the circumferential position of the vehicles. As a result, the vehicles may be driven to rotate about the guide axis to adjust the circumferential position of the vehicles during operation of the attraction.

With the foregoing in mind, FIG. 1 illustrates an embodiment of a top view of a racer 10. The racer 10 includes vehicles 12 coupled to a guide 14 via arms 16. The guide 14 is configured to direct movement of the vehicles 12 along a track 18 in an operation direction 20. That is, the guide 14 is driven along the track 18 and the vehicles 12 follow the movement of the guide 14. While the illustrated embodiments include a substantially straight track 18, in other embodiments the track 18 may be arcuate, circular, polygonal, or any other shape that may simulate a road or driving path (e.g., river). For example, the track 18 may include S-shaped bends and hair-pin turns to enhance the excitement provided to a rider during operation. In certain embodiments, the guide 14 may include rollers (e.g., wheels) configured to couple to the track 18 to enable movement along the track 18 in the operation direction 20. In still further embodiments, the guide 14 and/or the track 18 may be disposed in a slot or groove under a ground surface 21 (e.g., a manufactured race surface) such that the guide 14 and/or the track 18 are substantially hidden from view of the passengers. In other words, the guide 14 and/or the track 18 may be blocked from view perspectives in the pods by the ground surface 21.

In the illustrated embodiment of FIG. 1, the vehicles 12 are configured to rotate about a guide axis 22 in a first rotation direction 24 (e.g., clockwise with respect to FIG. 1) and a second rotation direction 26 (e.g., counter-clockwise with respect to FIG. 1). Moreover, the guide 14 may rotate about the guide axis 22 in the first rotation direction 24 and the second rotation direction 26. As will be described in detail below, rotation of the vehicles 12 and/or the guide 14 about the guide axis 22 may enable adjustment of the position of the vehicles 12 relative to one another, thereby producing the illusion of one vehicle 12 moving ahead of another vehicle 12 in a race. It will be appreciated that while the illustrated embodiment includes three vehicles 12 positioned about the guide 14, in other embodiments there may be 1, 2, 4, 5, 6, 7, 8, 9, 10 or any suitable number of vehicles 12.

Figure 2:
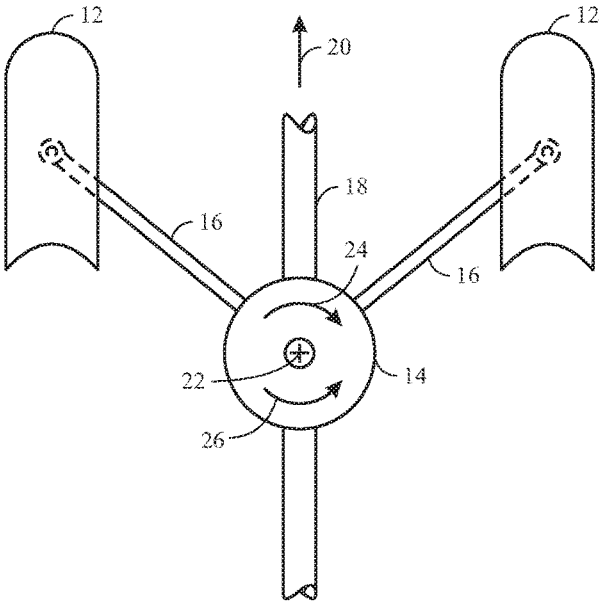
FIG. 2 is a top view of an embodiment of a racer having two vehicles positioned about a guide, in accordance with an aspect of the present disclosure.
Figure 3:
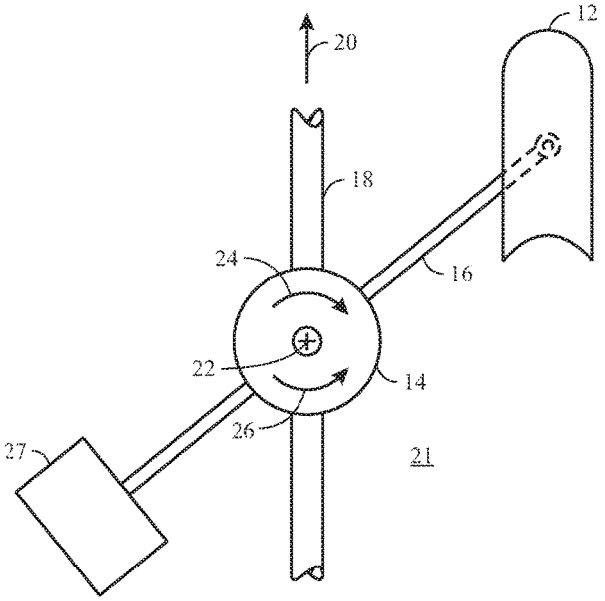
FIG. 3 is a top view of an embodiment of a racer having one vehicle positioned about a guide, in accordance with an aspect of the present disclosure.

For example, FIG. 2 is a top view of the racer 10 having two vehicles 12 positioned about the guide 14. Moreover, FIG. 3 is a top view of the racer 10 having one vehicle 12 positioned about the guide. In the illustrated embodiment of FIG. 3, a counterbalance 27 may be positioned opposite the vehicle 12 to reduce any stresses on the guide 14 and/or the track 18 caused by the weight of the vehicle 12. In some embodiments, the counterbalance 27 may be disposed in a slot or groove underneath the ground surface 21, such that the counterbalance 27 is hidden from a view of the passengers. Additionally, in the embodiment of FIG. 3, there may be multiple tracks 18 and/or guides 14 to enable several vehicles 12 to race independently of one another (e.g., vehicles 12 coupled to separate tracks 18 may be directed in the same general direction to simulate a race). In other embodiments, the racer 10 may not include the counterbalance 27.

Figure 4:
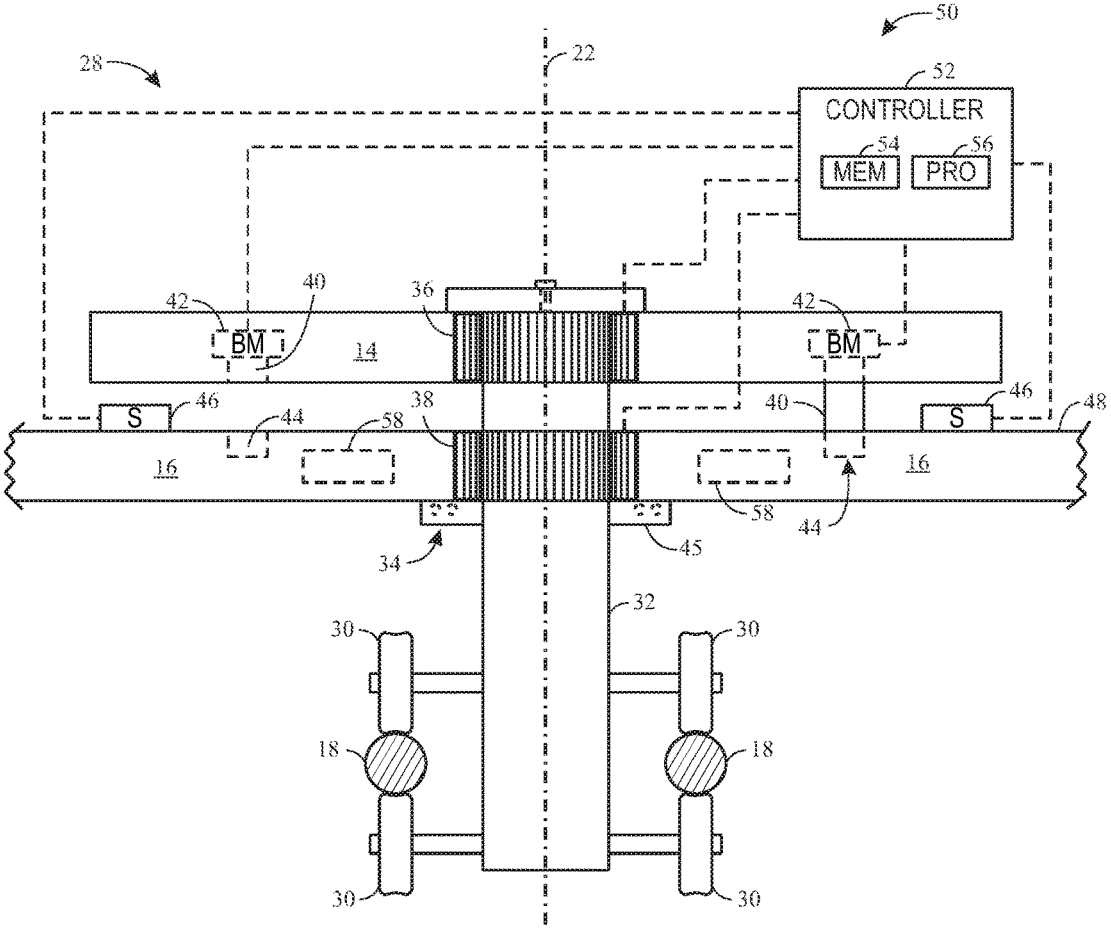
FIG. 4 is a cross-sectional elevation view of an embodiment of a motion system of the racer of FIG. 1, in accordance with an aspect of the present disclosure.

FIG. 4 is a cross-sectional side view of a motion system 28 configured to drive movement and/or rotation of the racer 10. The motion system 28 is movably coupled to the track 18 via rollers 30. In certain embodiments, the rollers 30 may include motors (e.g., electric motors) to drive rotational movement of the rollers 30 to propel the racer 10 along the track 18 in the operation direction 20 (and/or the opposite direction). Accordingly, the vehicles 12 may travel along the track 18 to simulate a race. In other embodiments, the rollers 30 may move along the track 18 via gravitational forces and/or any other suitable technique for driving the racer 10 along the track 18. Furthermore, a body 32 is coupled to and supports the rollers 30. As will be appreciated, the body 32 may be formed from metals (e.g., steel), composite materials (e.g., including carbon fiber), or the like. In the illustrated embodiment, the body 32 includes a pivot 34 that enables the guide 14 and the arms 16 to rotate about the guide axis 22, thereby adjusting the circumferential position of the vehicles 12 with respect to the guide axis 22.

In the illustrated embodiment, the guide 14 includes a first actuator 36 configured to drive rotational movement of the guide 14 about the guide axis 22 (and in some embodiments, movement of the arms 16 about the guide axis 22). For example, the first actuator 36 may be a yaw drive that transmits rotational movement between interlocking gears. Also, in other embodiments, the first actuator 36 may be a rotary actuator configured to drive rotation of the guide 14 upon receipt of a signal from a control system. Rotation of the guide 14 may adjust the position of the vehicles 12 relative to one another, thereby providing an illusion of one vehicle 12 passing another during a race. As will be described below, in certain embodiments, rotation of the guide 14 may not adjust the position of the vehicles 12. For example, in certain embodiments, the vehicles 12 may not be rotationally coupled to the guide 14.

As shown in FIG. 4, the arms 16 of the vehicles 12 are rotationally coupled to the pivot 34 to enable individual, selective rotation of the vehicles 12 about the guide axis 22 via a second actuator 38 (e.g., a respective second actuator for each vehicle 12 or group of vehicles 12). As described above with respect to the guide 14, the second actuator 38 drives rotation of the arm 16 about the guide axis 22 to adjust the position of the vehicle 12 relative to the other vehicles 12. Accordingly, the vehicles 12 may be individually rotated about the guide axis 22 to independently adjust the position of the vehicles 12 relative to one another. However, in certain embodiments, the arms 16 may be coupled to the guide 14 such that rotation of the guide 14 about the guide axis 22 drives rotation of each of the arms 16 about the guide axis 22. For example, the guide 14 may include a pin 40 driven by a biasing member 42. In certain embodiments, the biasing member 42 includes a linear actuator (e.g., a screw drive, a magnetic drive, an electric drive) that applies a force to drive the pin 40 toward the arm 16. The pin 40 may engage a recess 44 in the arm 16 and thereby removably couple the arm 16 to the guide 14. As will be appreciated, the pins 40 may be positioned about a circumference of the guide 14 to enable the arms 16 to couple to the guide 14 at different circumferential positions about the circumference of the guide 14. Rotation and support may be facilitated by bearing boxes 45 adjacent the arms.

In certain embodiments, the arms 16 includes sensors 46 positioned on a top surface 48 of the arms 16 between the arms 16 and the guide 14. However, it is understood that in embodiments where the arms 16 are positioned above the guide (e.g., relative to the track 18), that the sensors 46 may be positioned on a bottom surface of the arms 16 such that the sensors 46 are positioned between the arms 16 and the guide 14. Moreover, in other embodiments, the sensors 46 may be positioned on the guide 14. The sensors 46 are configured to detect the position of the arms 16 relative to the guide 14. In other words, the sensors 46 are configured to detect the circumferential position of the arms 16 about the guide axis 22. For example, the sensors 46 may include Hall effect sensors, capacitive displacement sensors, optical proximity sensors, inductive sensors, string potentiometers, electromagnetic sensors, or any other suitable sensor. In certain embodiments, the sensors 46 are configured to send a signal indicative of a position of the arm 16 to a control system (e.g., local and/or remote). Accordingly, the sensors 46 may be utilized to adjust the position of the arms 16 about the guide axis 22 and/or to facilitate engagement (or disengagement) of the pins 40.

As mentioned above, the motion system 28 may include a control system 50 configured to control movement and/or rotation of the guide 14 and/or the arms 16. The control system 50 includes a controller 52 having a memory 54 and one or more processors 56. For example, the controller 52 may be an automation controller, which may include a programmable logic controller (PLC). The memory 54 is a non-transitory (not merely a signal), tangible, computer-readable media, which may include executable instructions that may be executed by the processor 56. That is, the memory 54 is an article of manufacture configured to interface with the processor 56.

The controller 52 receives feedback from the sensors 46 and/or other sensors that detect the relative position of the motion system 28 along the track 18. For example, the controller 52 may receive feedback from the sensors 46 indicative of the position of the arms 16, and therefore the vehicles 12, relative to the other arms 16. Based on the feedback, the controller 52 may regulate operation of the racer 10 to simulate a race. For example, in the illustrated embodiment, the controller 52 is communicatively coupled to the first actuator 36, the second actuator 38, and the biasing member 42. Based on feedback from the sensors 46, the controller 52 may instruct the first and second actuators 36, 38 to drive rotation of the guide 14 and/or the arms 16 to change the position of the vehicles 12 relative to one another.

Figure 5:
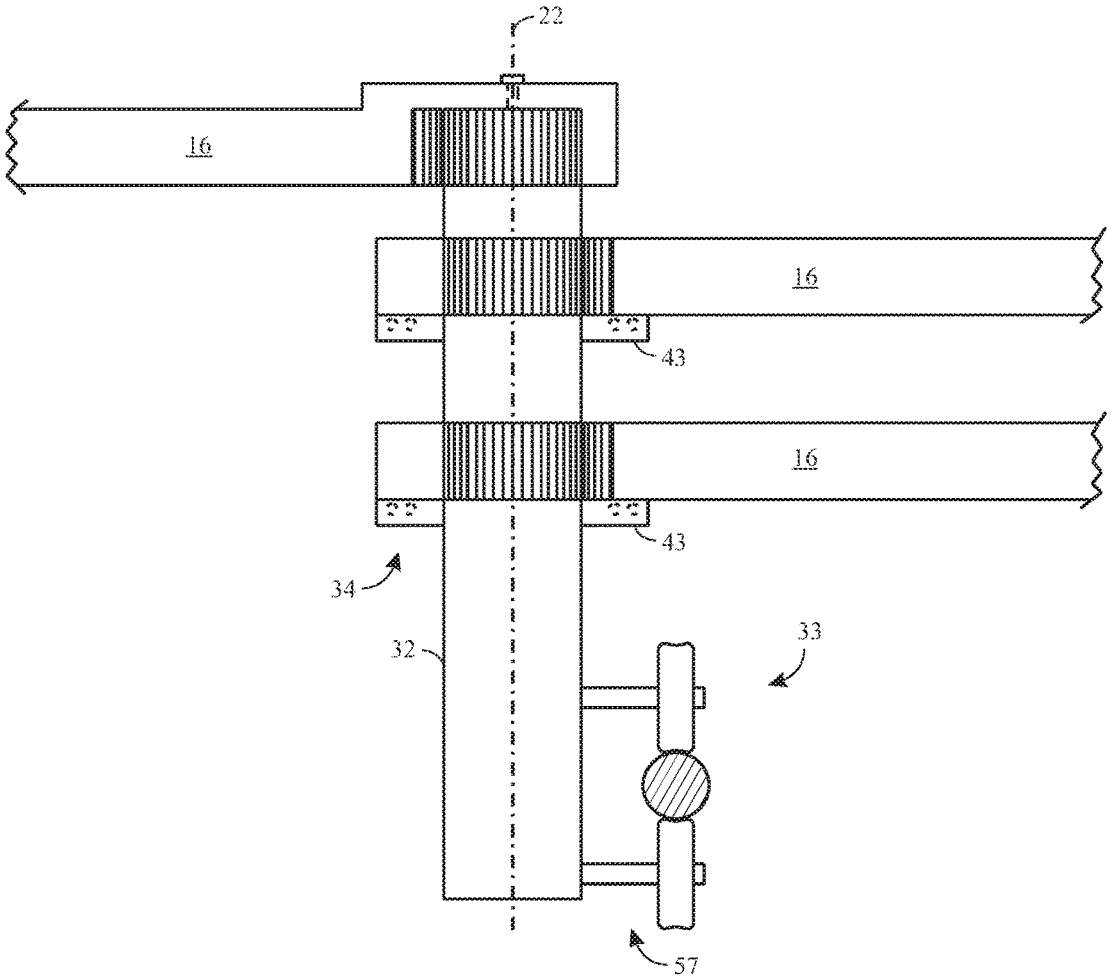
FIG. 5 is a cross-sectional elevation view of an embodiment of a bogie system of a racer, in accordance with an aspect of the present disclosure.

Variations in the arrangement of the arms 16 and the mechanism for driving the arms 16 in the operation direction 20 are also within the scope of the present disclosure. For instance, referring briefly to FIG. 5, each arm 16 may be individually driven such that at least some overlap occurs. In such an embodiment, the arms may connect in offsetting positions along the pivot 34 to facilitate such overlap. FIG. 5 also illustrates an embodiment of the racer 10 without the guide 14 but including the body 32 and bogies 33, which may be referred to as a bogie system 57.

Figure 6:
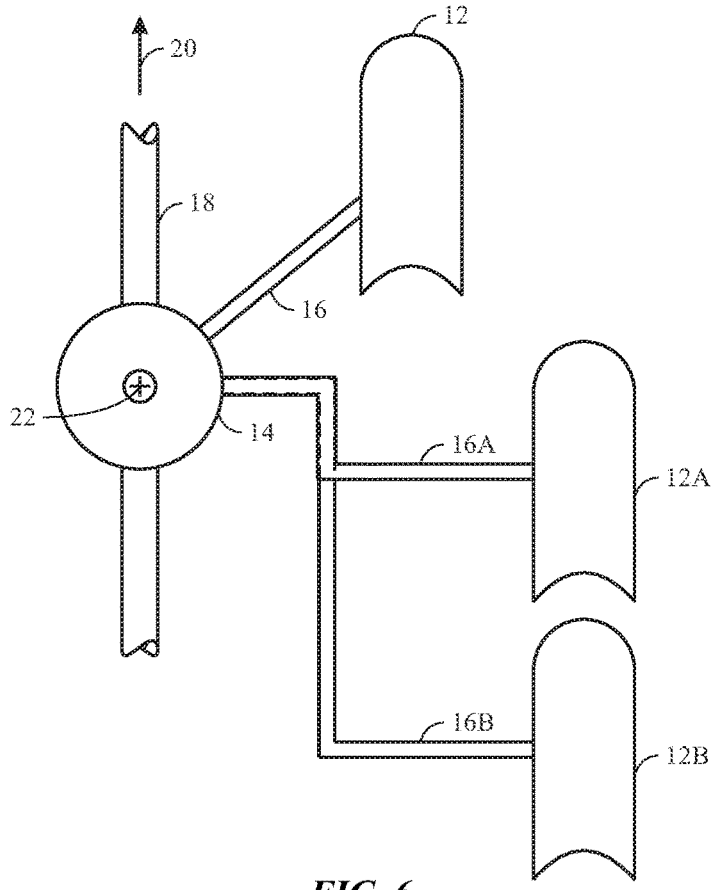
FIG. 6 is a top view of an embodiment of a racer having one or more arms that include a dogleg or bend, in accordance with an aspect of the present disclosure.

Furthermore, in certain embodiments, the arms 16 may not have the same length (e.g., radial extent from the guide axis 22) or the vehicles 12 may be distanced differently along the lengths, thereby enabling the arms 16 to overlap one another as the arms 16 rotate about the guide axis 22 without having the vehicles 12 contact each other. Additionally, in some embodiments, the arms 16A and/or 16B may include a dogleg, a bend, or a curvature along a length of the arms 16, such that when the arms 16 overlap, a distance between the body 32 of the vehicles 12 is reduced (e.g., the dogleg, the bend, and/or the curvature may enable the vehicles to overlap in a more compact configuration), as shown in FIG. 6. Accordingly, passengers may receive enhanced amusement from a perception that the vehicles 12 may collide as a result of the reduced distance.

Returning now to the illustrated embodiment of FIG. 4, the controller 52 may be configured to include virtual position thresholds and/or electronic stops that may block the vehicles 12 from contacting one another based on feedback received from the sensors 46. In some embodiments, the arms 16 may include blocking members 58 extending from the arms 16 in a direction crosswise relative to a longitudinal axis of the arms 16. The blocking members 58 are configured to act as mechanical stops, which block the arms 16 from coming within a predetermined distance of one another. For example, the predetermined distance may be a distance that blocks the vehicles 12 from contacting one another during operation. Moreover, the blocking members 58 may be positioned at any radial distance along the arms 16, with respect to the guide axis 22. For example, in the illustrated embodiment, the blocking members 58 are positioned at approximately one-fourth the radial extent of the arms 16. However, in other embodiments, the blocking members 58 may be positioned at approximately one-third the radial extent of the arms 16, approximately one-half the radial extent of the arms 16, approximately three-fourths the radial extent of the arms 16, or any other suitable distance from the guide axis 22. As used herein, approximately refers to plus or minus five percent. Accordingly, the blocking members 58 may be configured to block the vehicles 12 from contacting one another during operation of the attraction.

Figure 7:
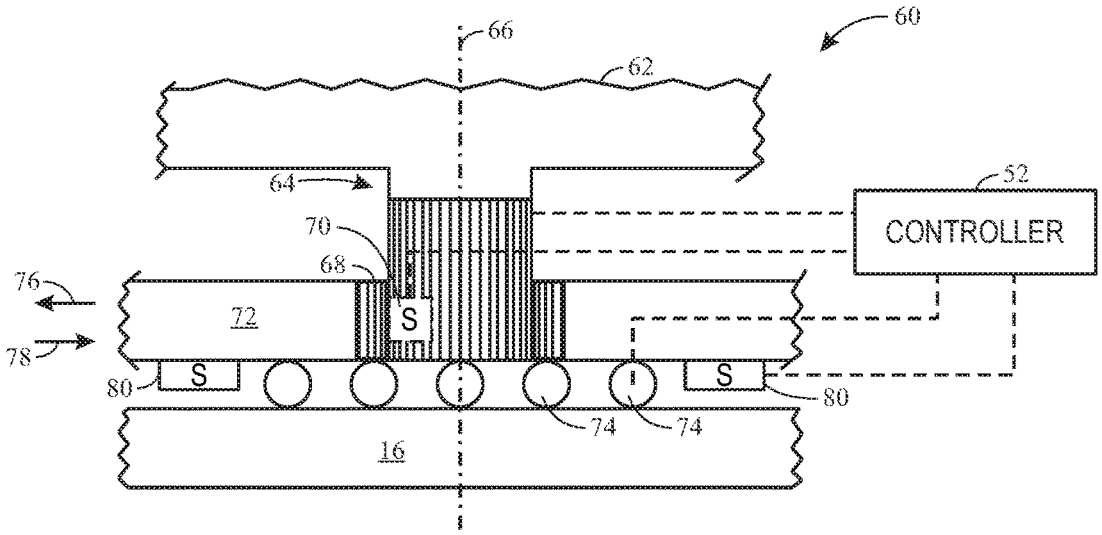
FIG. 7 is a cross-sectional elevation view of an embodiment of a vehicle coupling system of the racer of FIG. 1, in accordance with an aspect of the present disclosure.

FIG. 7 is a cross-sectional side view of an embodiment of a vehicle coupling system 60 configured to couple the vehicles 12 to the arms 16. In the illustrated embodiment, the vehicle 12 includes a body 62 coupled to a vehicle pivot 64. The vehicle pivot 64 may be driven to rotate about a vehicle axis 66 via a third actuator 68. As a result, the body 62 may be rotated about the vehicle axis 66, thereby enabling the rider to rotate about the vehicle axis 66 during operation of the attraction. For example, the body 62 may rotate about the vehicle axis 66 while the vehicle 12 approaches a turn or curved portion of the track 18, thereby simulating a car steering into the curve. Moreover, a rotation sensor 70 may be positioned proximate to the third actuator 68 to determine the rotational position (e.g., the circumferential position) of the body 62 relative to the vehicle axis 66. For example, the body 62 may be driven to rotate about the vehicle axis 66 in the first rotation direction 24 and the second rotation direction 26. The rotation sensor 70 may output a signal to the controller 52 indicative of the rotation of the body 62, thereby enabling the controller 52 to output signals to the third actuator 68 to rotate the body 62 to simulate driving along the track 18.

In the illustrated embodiment, the third actuator 68 is coupled to a platform 72 having rollers 74 positioned on the arm 16. The rollers 74 enable the platform 72, and therefore the body 62, to move along the arm 16 in a first radial direction 76 and a second radial direction 78. As used herein, the first radial direction 76 will refer to movement inwards and/or towards the guide axis 22. Moreover, the second radial direction 78 will refer to movement outwards and/or away from the guide axis 22. Enabling movement of the vehicle 12 along the arm 16 enables different motion configurations. For example, this may be utilized to simulate the illusion of the vehicle 12 attempting to "pass" the vehicle 12 positioned immediately in front of the vehicle 12, as will be described in detail below. Moreover, movement of the vehicles 12 along the arm 16 may enable the vehicles 12 to get closer to one another during operation, thereby enhancing the excitement experienced by the rider. Additionally, the arms 16 may include a telescoping configuration that enables movement of the vehicles 12 (e.g., the body 62) in the first and second radial directions 76, 78 without the use of the rollers 74. The arms 16 may include telescoping segments that may be powered by an actuator or other suitable device such that the vehicles 12 may move radially with respect to the guide axis 22. For example, the arms 16 may be configured to extend in the second radial direction 78 such that the vehicles 12 move away from the guide axis 22 and retract in the first radial direction such that the vehicles 12 move toward the guide axis 22. However, in some embodiments, the motion system 28 does not include features for movement of the vehicles 12 radially along the arms 16. For example, the vehicles 12 may be rigidly or merely pivotably coupled to the arms 16.

As shown in the illustrated embodiment of FIG. 7, the body 62 is configured to move along the arm 16 via the rollers 74. In certain embodiments, the rollers 74 may include an electric motor to drive (e.g., via a linkage) the vehicle 12 in the first and second radial directions 76, 78. Moreover, an arm position sensor 80 may be positioned on the platform 72. The arm position sensor 80 is configured to output a signal indicative of the radial position of the vehicle 12 along the arm 16. For example, the arm position sensor 80 may be a capacitive displacement sensor that outputs a signal to the controller 52. In certain embodiments, movement along the arm 16 may be utilized to simulate the vehicle 12 moving into position to pass another vehicle 12. Moreover, while the illustrated embodiment includes the arm position sensor 80 on the platform 72, in other embodiments the arm position sensor 80 may be positioned on the arm 16.

Figure 8:
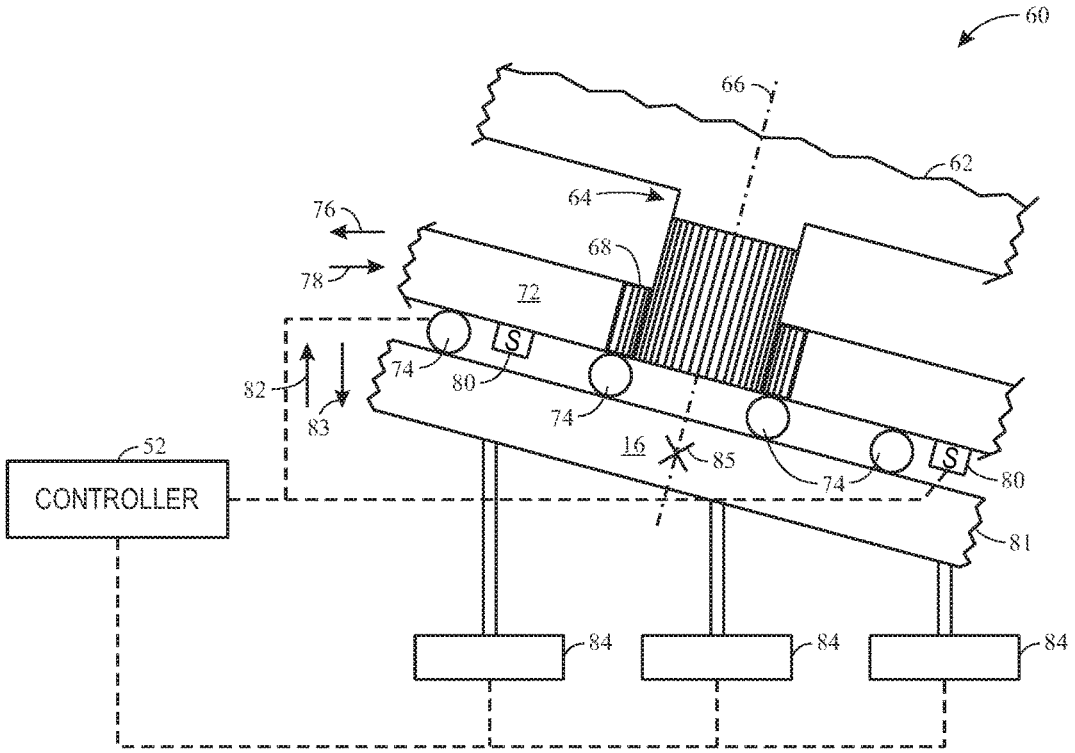
FIG. 8 is a cross-sectional side view of another embodiment of the vehicle coupling system of FIG. 6 that utilizes an adjustable swash plate and rollers, in accordance with an aspect of the present disclosure.

In still further embodiments, the body 62 may be configured to move in the first and second radial directions 76, 78 using an adjustable swash plate 81 as the arm 16. For example, FIG. 8 is a cross-sectional side view of another embodiment of the vehicle coupling system 60 that utilizes the adjustable swash plate 81 and the rollers 74. As shown in the illustrated embodiment of FIG. 8, the adjustable swash plate 81 may move in a first vertical direction 82 and/or a second vertical direction 83 via one or more actuators 84. Accordingly, rather than utilizing an electric motor to move the body 62 in the first and second radial directions 76, 78, the one or more actuators 84 may adjust the position of the adjustable swash plate 81, such that the body 62 moves in the first and second radial directions 76, 78 as a result of the gravitational forces (and centrifugal forces) acting on the body 62. Such an embodiment may be desirable because riders may experience enhanced amusement as a result of the vehicle 12 rotating along an axis 85 (e.g., the axis 85 is defined by the operation direction 20), and thus moving with an additional degree of freedom.

In some embodiments, the one or more actuators 84 may be coupled to the controller 52, which may activate and/or deactivate the one or more actuators 84 to move the body 62 in the first and second radial directions 76, 78. The controller 52 may receive feedback from the arm position sensor 80 to determine a position of the body 62 along the arm 16 (e.g., the adjustable swash plate 81), and send one or signals to the actuators 84 to adjust the position of the body 62 to a desired location. As discussed above, movement of the body 62 in the first and second radial directions 76, 78 may enable the vehicles 12 to move with respect to one another and create a perception that the vehicles 12 are racing one another. Additionally, in other embodiments, the adjustable swash plate 81 may be utilized to adjust a position of the guide 14, which may enable the arms 16 to overlap with one another.

Figure 9:
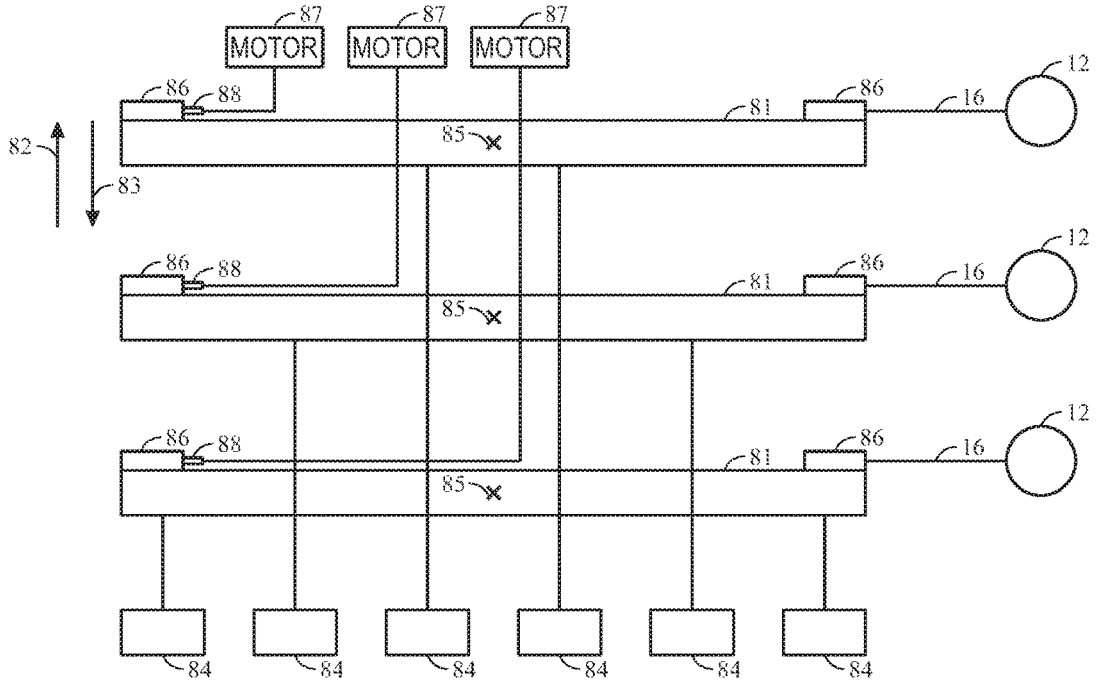
FIG. 9 is a schematic of another embodiment of the vehicle coupling system of FIG. 6 that utilizes multiple adjustable swash plates that include rotatable plates, in accordance with an aspect of the present disclosure.

FIG. 9 is a schematic of another embodiment of the racer 10 that may include multiple adjustable swash plates 81. In the illustrated embodiment of FIG. 9, the adjustable swash plates 81 include rotatable plates 86, which may be coupled to the arms 16. In some embodiments, the rotatable plates 86 may form a ring along a perimeter of the adjustable swash plates 81. The rotatable plates 86 may rotate with respect to the adjustable swash plates 81, thereby rotating the arms 16 and the vehicles 12. To rotate the rotatable plates 86, motors 87 may supply power to a driving device 88 (e.g., gears, wheels, tires, and/or rotatable actuators), which may direct rotatable plates 86 in the first rotation direction 24 and/or the second rotation direction 26. The adjustable swash plates 81 may each include one or more of the actuators 84, which may enable movement of the vehicles 12 in the first vertical direction 82 and/or the second vertical direction 83. Accordingly, each vehicle 12 may rotate in the first rotation direction 24 and/or the second rotation direction 26 independent from the other vehicles 12, and each vehicle 12 may move in the first vertical direction 82 and/or the second vertical direction 83 independent from the other vehicles 12.

Figure 10:
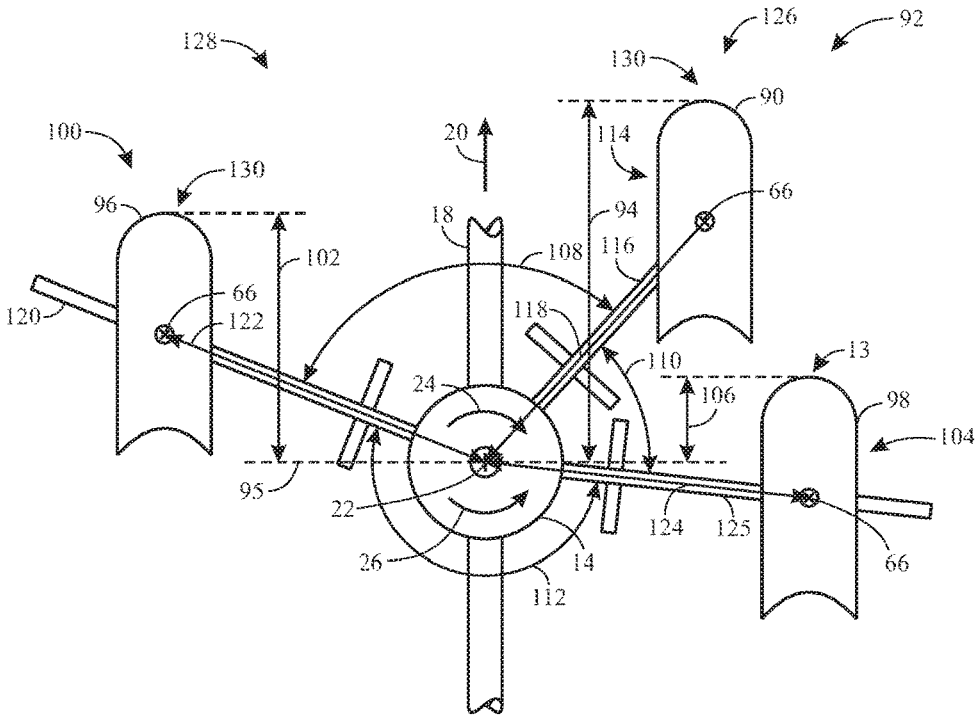
FIG. 10 is a top view of an embodiment of the racer of FIG. 1, in which a first vehicle is in a first place position, a second vehicle is in a second place position, and a third vehicle is in a third place position, in accordance with an aspect of the present disclosure.

FIG. 10 is a top view of an embodiment of the racer 10 having three vehicles in which the vehicles 12 are traveling along the track 18 in the operation direction 20. As shown, a first vehicle 90 is in a first place position 92. While in the first place position 92, the first vehicle 90 is at a first distance 94, relative to the a moving axis 95 that is orthogonal to the intersection of the guide axis 22 and the operation direction 20 and extending along a plane defined by the surface 21. As a result, the first vehicle 90 may be described as being in "first place" relative to a second vehicle 96 and a third vehicle 98. Additionally, the second vehicle 96 is at a second place position 100. While in the second place position 100, the second vehicle 96 is at a second distance 102, relative to the moving axis 95. Accordingly, the second vehicle 96 may be described as being in "second place" relative to the first vehicle 90 and the third vehicle 98. Furthermore, the third vehicle 98 is in a third place position 104. While in the third place position 104, the third vehicle 98 is at a third distance 106, relative to the moving axis 95. As a result, the third vehicle 98 may be described as being in "third place" relative to the first vehicle 90 and the second vehicle 96. It will be understood that respective lengths of the first, second, and third distances 94, 102, 106 may vary to correspond to the first, second, and third place positions 92, 100, 104. In other words, the first distance 94 corresponds to the first place position 92, the second distance 102 corresponds to the second place position 100, and the third distance 102 corresponds to the third place position 104, notwithstanding the numeric values of the first, second, and third distances 94, 102, 106.

In the illustrated embodiment, the first vehicle 90 is at a first angle 108, relative to the second vehicle 96. As will be appreciated, the first angle 108 may be adjusted via the first actuator 36 (via coupling of the arms 16 to the guide 14) and/or via the second actuator 38. As mentioned above, the second actuator 38 may be a yoke drive configured to engage corresponding gears of the arms 16. In certain embodiments, the arms 16 may be individually rotatable about the guide axis 22 by selectively engaging individual arms 16 with the second actuator 38. As a result, the first angle 108 may be adjusted during operation of the attraction. Moreover, the first vehicle 90 may be at a second angle 110, relative to the third vehicle 98. Additionally, the second vehicle 96 may be at a third angle 112, relative to the third vehicle 98. As will be described below, the relative angles between the first, second, and third vehicles 90, 96, 98 may be adjusted during operation of the attraction.

As shown in FIG. 10, the first vehicle 90 is positioned at a distal end 114 of a first arm 116. In other words, the rollers 74 may drive the platform 72 in the second radial direction 78 such that the first vehicle 90 is at a first radial distance 118 from the guide axis 22. However, the second vehicle 96 is positioned at approximately a mid-point of a second arm 120 via movement in the first radial direction 76 by rollers 74, for example. As a result, the second vehicle 96 is at a second radial distance 122 from the guide axis 22. In the illustrated embodiment, the second radial distance 122 is less than the first radial distance 118. However, in other embodiments, the first radial distance 118 may be smaller than the second radial distance 122, or the first radial distance 118 may be equal to the second radial distance 122. Moreover, in the illustrated embodiment, the third vehicle 98 is at a third radial distance 124 along a third arm 125 via movement in the first radial direction 76. As shown, the third radial distance 124 is less than the first radial distance 118, and greater than the second radial distance 122. Accordingly, radial distance of the first, second, and third vehicles 90, 96, 98 may be adjusted relative to the guide axis 22. As a result, the riders may experience enhanced excitement during operations because the vehicles 12 are configured to move in a variety of directions relative to the guide axis 22.

As described above, the arms 16 are configured to rotate about the guide axis 22 to simulate a race between the vehicles 12. In the illustrated embodiment, the first vehicle 90 and the third vehicle 98 are positioned on a first side 126 of the track 18. Moreover, the second vehicle 96 is positioned on a second side 128. During operation of the attraction, the vehicles 12 may rotate about the guide axis 22, and thereby move between the first and second sides 126, 128. In certain embodiments, the vehicles 12 may be substantially aligned with the track 18. Furthermore, movement from the first side 126 to the second side 128 may be driven by the second actuator 38 as the second actuator 38 selectively drives rotation of the arms 16. However, in other embodiments, the arms 16 may be locked to the guide 14, via the pin 40, and the first actuator 36 may drive rotation of the guide 14 about the guide axis 22, and thereby facilitate a corresponding rotation of the arms 16 about the guide axis 22. Accordingly, the vehicles 12 may be driven to rotate about the guide axis 22 to simulate movement along a raceway during operation of the attraction.

Figure 11:
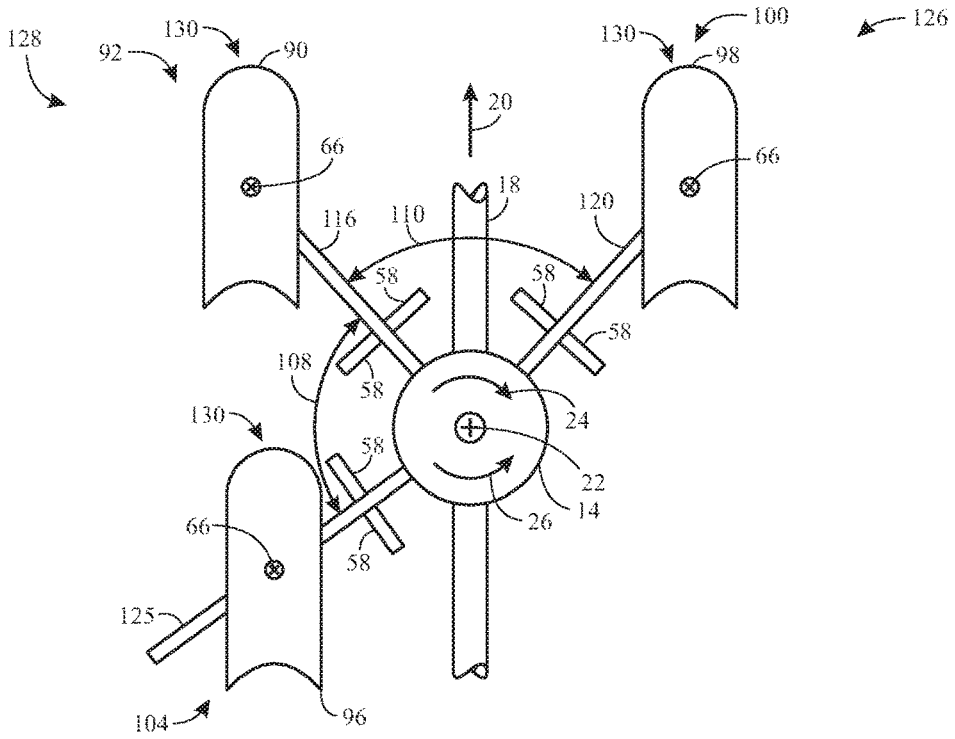
FIG. 11 is a top view of the racer of FIG. 10, in which the first vehicle is in the first place position, the second vehicle is in the third place position, and the third vehicle is in the second place position, in accordance with an aspect of the present disclosure.

FIG. 11 is a top view of an embodiment of the racer 10 in which the first vehicle 90 is in the first place position 92 and the third vehicle 98 is in the second place position 100. Comparing the position of the first, second, and third vehicles 90, 96, 98 in FIG. 10 to FIG. 11 the first vehicle 90 remains in the first place position 92, but has moved to the second side 128 of the track 18. Moreover, the third vehicle 98 has moved to the second place position 100. Additionally, the second vehicle 96 has moved to the third place position 104. In the illustrated embodiment, rotation of the guide 14 about the guide axis 22 may drive the vehicles 12 to rotate about the guide axis 22, via engagement of the pins 40. For example, as shown in FIGS. 8 and 9, the first vehicle 90 rotates about the guide axis 22 in the second rotation direction 26 to move to the second side 128. Moreover, the first angle 108 remains substantially unchanged between FIGS. 8 and 9. However, in other embodiments, the second actuator 38 may drive individual movement of the arms 16 about the guide axis 22. In other words, the first angle 108, second angle 110, and third angle 112 may change as the vehicles 12 move between the first place position 92, the second place position 100, and the third place position 104.

Furthermore, as the vehicles 12 move between the first place position 92, the second place position 100, and the third place position 104, the vehicles 12 may rotate about the vehicle axis 66 to orient a front end 130 of the vehicles 12 along the operation direction 20. For example, in the illustrated embodiment of FIG. 11, the track 18 is substantially straight, and as a result the front ends 130 of the vehicles 12 are oriented along the path of the track 18. However, in other embodiments, the front end 130 may be not oriented along the operation direction 20. For example, the vehicles 12 may be configured to "spin out" or "drift" along a sharp curve. Accordingly, the rotation of the vehicles 12 may be controlled to point the front ends 130 away from the operation direction 20 (e.g., in an opposite direction, in a direction substantially perpendicular). Rotation of the vehicles 12 about the vehicle axis 66 may enhance excitement for riders and increase variability of the outcomes of the races between the vehicles 12.

Figure 12:
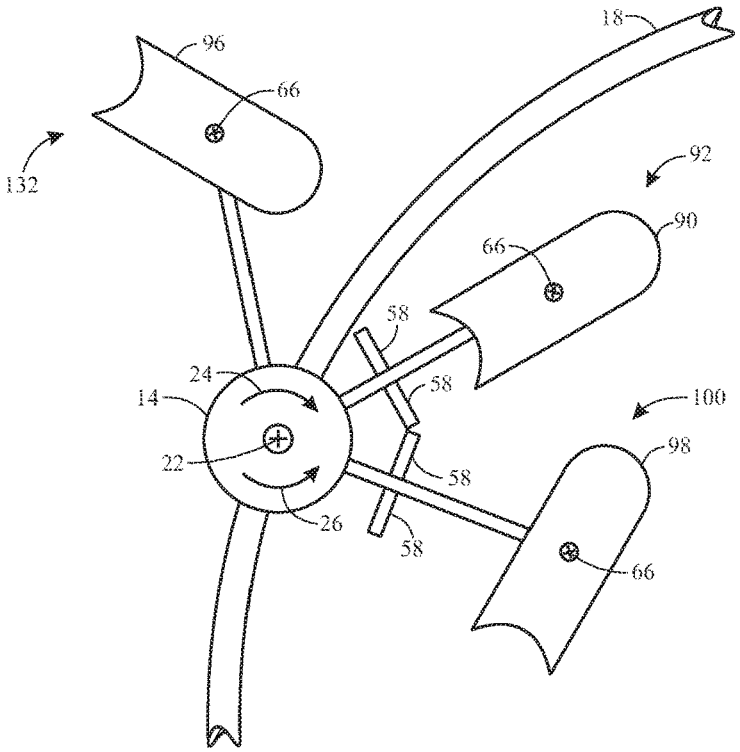
FIG. 12 is a top view of an embodiment of the racer of FIG. 1, in which a track includes a curved section, in accordance with an aspect of the present disclosure.

FIG. 12 is a top view of the racer 10 in which the track 18 is arcuate. As shown, the track 18 includes a bend or curve to simulate a turn. Because the operation direction 20 is substantially along the curve of the track 18, the first vehicle 90 and the third vehicle 98 are driven to rotate about the respective vehicle axis 66 to orient the front ends 130 along the operation direction 20. However, as mentioned above, the second vehicle 96 may be in a spin out position 132, as shown in the illustrated embodiment of FIG. 12. As shown, rotation about the vehicle axis 66 of the second vehicle 96 orients the front end 130 out of alignment with the operation direction 20. Accordingly, the riders may experience the sensation of losing control of their vehicle 12 around the curve. In certain embodiments, the controller 52 may be configured to direct rotation of the second vehicle 96 about the guide axis 22 toward the third position 104 to simulate the impact of the spin out during the race with the first and third vehicles 90, 98. In other words, vehicles 12 that spin-out may fall behind the other vehicles 12 in the race.

Furthermore, as shown in FIG. 12, the blocking members 58 of the first vehicle 90 and the third vehicle 98 are in contact with one another. As described above, the blocking members 58 are positioned along the arms 16 to block contact between the vehicles 12 as the vehicles 12 rotate about the guide axis 22. For example, the blocking members 58 may be positioned on the arms 16 to enable the arms 16 to come within a predetermined angle of one another. In certain embodiments, the predetermined angle may enable rotation of the vehicles 12 about the vehicle axis 66 without contacting the adjacent vehicle 12.

Figure 13:
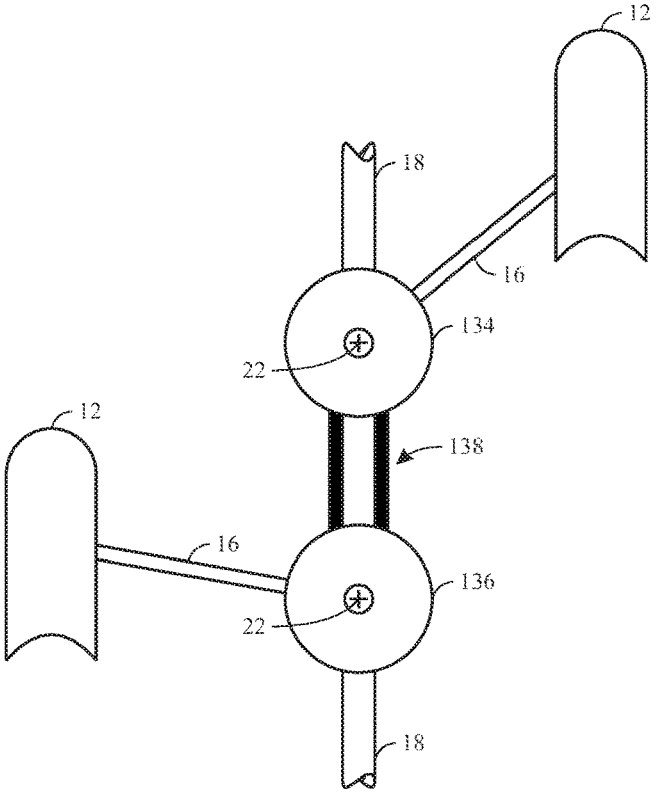
FIG. 13 is a top view of an embodiment of an attachment mechanism coupling a first guide to a second guide, in accordance with an aspect of the present disclosure.

FIG. 13 is a top view of an embodiment of the racer 10 in which a first guide 134 is coupled to a second guide 136 via an attachment member 138. In the illustrated embodiment, the first guide 134 includes a single vehicle 12 and the second guide 136 includes a single vehicle 12. However, in other embodiments, the first and second guides 134, 136 may include 2, 3, 4, 5, or any suitable number of vehicles 12. Moreover, in other embodiments the first and second guides 134, 136 may not have the same number of vehicles 12. For example, the first guide 134 may include two vehicles 12 while the second guide 136 includes a single vehicle 12. In the illustrated embodiment, the attachment member 138 is configured to couple the second guide 136 to the first guide 134, thereby enabling riders in the first and second guides 134, 136 to race one another. For example, the second guide 136 may couple to the first guide 134 during operation of the attraction to simulate the second guide 136 catching up to the first guide 134. Thereafter, the vehicles 12 of the respective first and second guides 134, 136 may rotate about the respective guide axis 22 as described in detail above. Moreover, while the illustrated embodiment includes the first and second guides 134, 136 coupled to one another, in other embodiments first and second bogie systems 35 may couple together during operation of the attraction via the attachment member 138.

Figure 14:
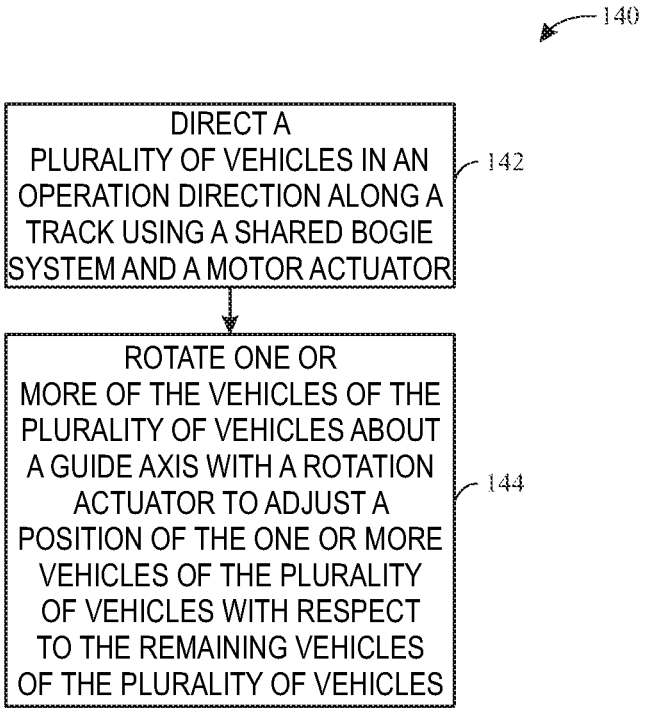
FIG. 14 is a flowchart of an embodiment of a method for controlling the position of the vehicles of the racer of FIG. 1, in accordance with an aspect of the present disclosure.

FIG. 14 is a flow chart of an embodiment of a method 140 for controlling the racer 10 during operation. At block 142, a plurality of the vehicles 12 may be directed in the operation direction 120 along the track 18 using the guide 14. Additionally, at block 144, one or more vehicles 12 of the plurality of vehicles 12 may be rotated about the guide axis 22 such that a position of the one or more vehicles 12 of the plurality of vehicles 12 may be adjusted with respect to the remaining vehicles 12 of the plurality of vehicles 12. In some embodiments, movement of the vehicles 12 in the operation direction 120 (e.g., gross movement) may be automated (e.g., a ride controller moves the guide 14 along the track 18 at a predetermined speed). However, in certain embodiments, movement of the vehicles 12 about the guide axis 22 (e.g., fine movement) may be controlled by the riders, themselves. Accordingly, the riders may ultimately have control over a position of the vehicles 12 with respect to one another at the end of the ride.

Additionally, a starting position of the vehicle 12 may be determined at by the controller 52, for example. The sensor 46 may transmit a signal to the controller 52 indicative of the arms 16 relative location along the circumference of the guide 14. In some embodiments, the controller 52 may determine the starting position (e.g., the first place position 92, the second place position 100, the third place position 104) based on the signal from the sensor 46. The operation direction 20 may also be determined. For example, sensors positioned on the guide 14 may determine the relative location of the guide 14 along the track 18, and thereby determine the shape of the track 18 and the operation direction 20. The controller 52 may send a signal to the vehicle 12 to rotate about the vehicle axis 66. For example, the track 18 may include a curved portion that adjusts the operation direction 20. The controller 52 may instruct the vehicle 12 to rotate about the vehicle axis 66 to align the front end 130 of the vehicle 12 with the operation direction 20. Moreover, in other embodiments, the controller 52 may instruct the vehicle 12 to rotate about the vehicle axis 66 to simulate a spin out or out-of-control condition. Further, a desired position of the vehicle 12 may be predetermined by the controller 52 (e.g., as opposed to controlled by the riders themselves). For example, the controller 52 may determine the first vehicle 90 will finish in the second place position 100. The controller 52 may then instruct the vehicle 12 to rotate about the guide axis 22. For example, the controller 52 may determine that the first vehicle 90 will finish in the second position 100 after starting in the third place position 104. The controller 52 may send a signal to the second actuator 38 to drive rotation of the first vehicle 90 about the guide axis 22 to move the first vehicle 90 into the second place position 100.

As described in detail above, the motion system 28 of the racer 10 may drive rotational movement of the vehicles 12 about the guide axis 22. For example, the second actuator 38 may be configured to drive rotation of the arms 16 coupled to the vehicles 12. Furthermore, in other embodiments, the arms 16 may be coupled to the guide 14 to enable rotation of the vehicles 12 while the guide 14 is driven to rotate about the guide axis 22. In certain embodiments, the vehicles 12 are configured to rotate about the vehicle axis 66. Rotation about the vehicle axis 66 enables alignment of the front end 130 of the vehicles 12 with the operation direction 20, thereby enhancing the simulation of driving along the track 18. Moreover, rotation about the vehicle axis 66 may facilitate spin-outs or drifting around curves during operation of the attraction. In certain embodiments, the control system 50 may be configured to control movement of the vehicles 12 during operation of the attraction. For example, the controller 52 may send or receive signals to drive rotation of the vehicles 12 about the guide axis 22 and/or about the vehicle axis 66. Accordingly, the racer 10 may simulate a race between vehicles 12 to provide entertainment to riders utilizing the attraction.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. An apparatus for an amusement park, comprising:

a bogie system positioned on a track, wherein the bogie system is configured to direct motion along the track;

an arm extending radially outward from the bogie system, wherein the arm is rotatably coupled to a body of the bogie system; and a vehicle configured to carry a passenger and positioned on the arm, wherein the bogie system is configured to move in an operation direction along the track and the vehicle is configured to rotate about the bogie system to change a position of the vehicle with respect to the bogie system, and wherein the vehicle is configured to move radially along a length of the arm.

2. The apparatus of claim 1, wherein the arm comprises rollers, telescoping segments, an adjustable swash plate, or a combination thereof, configured to enable the vehicle to move radially along the length of the arm.

3. The apparatus of claim 1, comprising a plurality of the arms extending radially outward from the bogie system, each arm of the plurality of the arms having a corresponding vehicle coupled thereto.

4. The apparatus of claim 3, wherein the corresponding vehicles are positioned at different locations from one another with respect to the bogie system.

5. The apparatus of claim 3, wherein each of the plurality of the arms is positioned offset from one another with respect to a rotational axis of the body of the bogie system.

6. The apparatus of claim 3, wherein each of the plurality of the arms comprises a blocking device configured to block contact between the corresponding vehicles.

7. The apparatus of claim 1, comprising a controller configured to determine a position of the vehicle relative to the arm and the track.

8. The apparatus of claim 1, comprising a counterweight extending radially outward from the bogie system in a direction opposite of the arm, wherein the counterweight is rotatably coupled to the body of the bogie system.

9. The apparatus of claim 1, comprising an additional bogie system, an additional arm, and an additional vehicle, wherein the additional bogie system is coupled to the bogie system and is positioned on the track, wherein the additional arm extends radially outward from the additional bogie system, wherein the additional arm is rotatably coupled to an additional body of the additional bogie system, wherein the additional vehicle is positioned on the additional arm, and wherein the additional bogie system is configured to move in the operation direction along the track and the additional vehicle is configured to rotate about the bogie system to change an additional position of the additional vehicle with respect to the bogie system.

10. A system, comprising:

a bogie system positioned on a track, wherein the bogie system is configured to move along the track in an operating direction;

a plurality of arms extending radially outward from the bogie system, wherein each arm of the plurality of arms is individually rotatably coupled to a body of the bogie system, wherein each arm of the plurality of arms is configured to independently rotate about the bogie system with respect to remaining arms of the plurality of arms; and a plurality of vehicles, wherein each vehicle of the plurality of vehicles is positioned on a corresponding arm of the plurality of arms, and wherein the bogie system is configured to move the plurality of arms and the plurality of vehicles together along the operation direction, and wherein each vehicle of the plurality of vehicles is positioned at different locations with respect to the operation direction.

11. The system of claim 10, comprising a controller configured to control rotation of each arm of the plurality of arms about the body of the bogie system and to control translation of each vehicle of the plurality of vehicles along the corresponding arm.

12. The system of claim 11, comprising one or more sensors configured to send feedback to the controller, wherein the feedback is indicative of a respective position of each vehicle of the plurality of vehicles with respect to the track and with respect to the other vehicles of the plurality of vehicles.

13. The system of claim 11, wherein the controller is configured to send a first signal to an actuator coupled to the body of the bogie system to rotate the plurality of arms about the body of the bogie system, and wherein the controller is configured to send a second signal to an electric motor configured to power rollers, telescoping segments, an adjustable swash plate, or a combination thereof, to translate each vehicle of the plurality of vehicles along the corresponding arm.

14. The system of claim 11, wherein the controller comprises virtual position thresholds configured to block the plurality of vehicles from contacting one another.

15. The system of claim 11, wherein the controller is configured to control rotation of each vehicle of the plurality of vehicles about a respective vehicle axis.

16. The system of claim 15, wherein the controller is configured to rotate each vehicle of the plurality of vehicles about the respective vehicle axis based on a respective position of each vehicle of the plurality of vehicles with respect to the track.

17. An apparatus for an amusement park, comprising:

a first bogie system positioned on a track, wherein the first bogie system is configured to direct motion along the track;

a first arm extending radially outward from the first bogie system, wherein the first arm is rotatably coupled to a first body of the first bogie system;

a first vehicle configured to carry a passenger and positioned on the first arm, wherein the first bogie system is configured to move in an operation direction along the track and the first vehicle is configured to rotate about the first bogie system to change a first position of the first vehicle with respect to the first bogie system;

a second bogie system coupled to the first bogie system and positioned on the track;

a second arm extending radially outward from the second bogie system, wherein the second arm is rotatably coupled to a second body of the second bogie system; and a second vehicle positioned on the second arm, wherein the second bogie system is configured to move in the operation direction along the track and the second vehicle is configured to rotate about the first bogie system to change a second position of the second vehicle with respect to the first bogie system.

18. The apparatus of claim 17, wherein the first vehicle, the second vehicle, or both are configured to rotate about a vehicle axis based on the operation direction along the track.

19. The apparatus of claim 17, wherein the first vehicle and the second vehicle are configured to independently rotate about the first bogie system to change the first position and the second position, respectively.

* * * * *